US012807877B2

(12) United States Patent
Sumiya

(10) Patent No.: US 12,807,877 B2
(45) Date of Patent: Nov. 24, 2026

(54) BIOCHAR PRODUCTION METHOD

(71) Applicant: TOYOTA JIDOSHA KABUSHIKI KAISHA, Toyota (JP)

(72) Inventor: Tadayoshi Sumiya, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 108 days.

(21) Appl. No.: 19/018,061

(22) Filed: Jan. 13, 2025

(65) Prior Publication Data

US 2025/0277153 A1 Sep. 4, 2025

(30) Foreign Application Priority Data

Mar. 1, 2024 (JP) ..... 2024-031267

(51) Int. Cl.

| | |
|---|---|
| ***C10B 53/02*** | (2006.01) |
| ***C10B 57/08*** | (2006.01) |
| ***C10B 57/14*** | (2006.01) |
| ***C10L 5/44*** | (2006.01) |
| ***C10L 9/08*** | (2006.01) |

(52) U.S. Cl.

CPC ..... *C10B 53/02* (2013.01); *C10B 57/08* (2013.01); *C10B 57/14* (2013.01); *C10L 5/44* (2013.01); *C10L 9/08* (2013.01); *C10L 2290/02* (2013.01)

(58) Field of Classification Search

CPC ..... C10B 53/02; C10B 57/08; C10B 57/14; C10L 5/44; C10L 9/08

See application file for complete search history.

(56) References Cited

U.S. PATENT DOCUMENTS

| | | | | |
|---|---|---|---|---|
| 8,100,990 | B2 * | 1/2012 | Ellens | C10L 5/447 44/589 |
| 9,359,268 | B2 * | 6/2016 | Cheiky | C10G 1/02 |
| 11,624,037 | B2 * | 4/2023 | Bai | C10L 5/445 44/589 |
| 12,077,720 | B2 * | 9/2024 | Bai | C10L 5/445 |
| 12,630,720 | B2 * | 5/2026 | Chen | C09C 1/44 |
| 2015/0033812 | A1 * | 2/2015 | Park | B01J 19/245 71/31 |
| 2022/0033727 | A1 * | 2/2022 | Bai | C10L 5/445 |

FOREIGN PATENT DOCUMENTS

| | | | |
|---|---|---|---|
| CN | 101333447 | A * | 12/2008 |
| JP | 2014-531487 | A | 11/2014 |
| WO | 2013/040403 | A1 | 3/2013 |
| WO | 2022/032152 | A1 | 2/2022 |

OTHER PUBLICATIONS

Espacenet Machine Translation of CN101333447 Obtained Jun. 24, 2026. (Year: 2026).*

* cited by examiner

*Primary Examiner* — Jonathan Miller
(74) *Attorney, Agent, or Firm* — Oliff PLC

(57) ABSTRACT

A biochar production method by which biochar having a stable pH can be produced even at a low heating temperature is provided. A biochar production method according to the present disclosure includes mixing a terrestrial-derived raw material, i.e., a terrestrial biomass, with a marine-derived raw material, i.e., a marine biomass, and heating the mixed raw material at a temperature higher than or equal to 300 °C but lower than or equal to 350 °C in a low oxygen atmosphere.

4 Claims, 3 Drawing Sheets

BIOCHAR PRODUCTION METHOD

CROSS REFERENCE TO RELATED APPLICATIONS

This application is based upon and claims the benefit of priority from Japanese patent application No. 2024-031267, filed on Mar. 1, 2024, the disclosure of which is incorporated herein in its entirety by reference.

BACKGROUND

The present disclosure relates to a biochar production method.

In recent years, biochar using biomass has been developed.

For example, Patent Literature 1 discloses a method for producing biochar mainly using terrestrial-derived biomass such as bamboo.

Patent Literature 1: Published Japanese Translation of PCT International Publication for Patent Application, No. 2014-531487

SUMMARY

The inventors have found the following problem regarding a biochar production method.

In the technology disclosed in Patent Literature 1, terrestrial-derived biomass is mixed mainly with marine-derived biomass. In order to use biochar as a soil conditioner, it is preferable that the biochar become a stable alkaline. Therefore, it is necessary to heat the mixed biomass at a high temperature in order to obtain biochar having a stable pH. However, in order to reduce the input of energy, it has been required to reduce the heating temperature during the production of biochar.

The present disclosure has been made in view of the above-described problem and an object thereof is to provide a biochar production method by which biochar having a stable pH can be produced even at a low heating temperature.

In order to achieve the above-described object, one aspect according to the present disclosure is a biochar production method including:

- mixing a terrestrial-derived raw material with a marine-derived raw material; and
- heating the mixed raw material at a temperature higher than or equal to 300 °C but lower than or equal to 350 °C in a low oxygen atmosphere.

According to the present disclosure, it is possible to provide a biochar production method by which biochar having a stable pH can be produced even at a low heating temperature.

The above and other objects, features and advantages of the present disclosure will become more fully understood from the detailed description given hereinbelow and the accompanying drawings.

DESCRIPTION OF EMBODIMENTS

Figure 1:
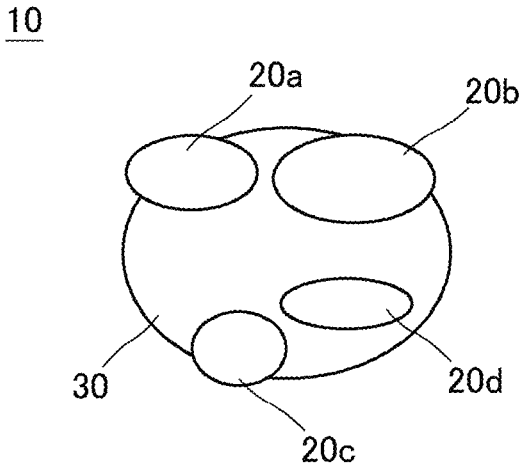
FIG. 1 is an enlarged schematic diagram of an example of biochar according to an embodiment.

Embodiments of the present disclosure will be described hereinafter in detail with reference to the drawings. The same or corresponding elements are denoted by the same reference symbols throughout the drawings, and redundant descriptions thereof will be omitted as necessary for the clarification of the description. Further, for facilitating the understanding of the present disclosure, the scale of each element in the drawings may differ from the actual scale thereof.

First, an example of a structure of biochar produced by a biochar production method according to this embodiment, that is, biochar according to this embodiment will be described with reference to FIG. 1. Biochar 10 according to this embodiment is charcoal produced using a biomass raw material, and is suitably used as a soil conditioner. As shown in FIG. 1, the biochar 10 includes a marine biomass 20 (20*a*, 20*b*, 20*c*, 20*d*) and a terrestrial biomass 30. The biochar 10 is produced by heating a mixed biomass obtained by mixing the marine biomass 20 with the terrestrial biomass 30.

The marine biomass 20 is a marine-derived raw material. The marine biomass 20 is produced using, for example, seaweed. The terrestrial biomass 30 is a terrestrial-derived raw material. The terrestrial biomass 30 is produced using, for example, bamboo or sugarcane. The marine biomass 20 and the terrestrial biomass 30 have particle sizes different from each other. A method for measuring particle sizes of the terrestrial biomass 30 and the marine biomass 20 is not limited to a particular method. Particle sizes of the terrestrial biomass 30 and the marine biomass 20 may be measured as, for example, median diameters. For example, a particle size median diameter of the marine biomass 20 may be about ¼ of that of the terrestrial biomass 30.

FIG. 1 illustrates the case where the marine biomass 20 has a particle size smaller than that of the terrestrial biomass 30. However, the marine biomass 20 may have a particle size larger than that of the terrestrial biomass 30. In this case, since the marine biomass 20 and the terrestrial biomass 30 have particle sizes different from each other, the marine biomass 20 and the terrestrial biomass 30 are more homogeneously mixed and compounded than in the case where the marine biomass 20 and the terrestrial biomass 30 have substantially the same particle size.

The marine biomass 20 and the terrestrial biomass 30 usually have pHs different from each other since they are composed of different materials. Therefore, a pH of the mixed biomass, i.e., a pH of the biochar 10, can be adjusted by adjusting a ratio of the mixture of the marine biomass 20 to that of the terrestrial biomass 30. Further, since the marine biomass 20 and the terrestrial biomass 30 are compounded in the biochar 10, there is no unevenness in the pH inside the biochar 10. Therefore, when the biochar 10 is sprayed on soil, the pH of all of the soil can be adjusted to have an intended pH. As a result of the pH of all of the soil being adjusted to have an intended pH, the effect of the biochar 10 as a soil conditioner can be fully exhibited.

Figure 2:
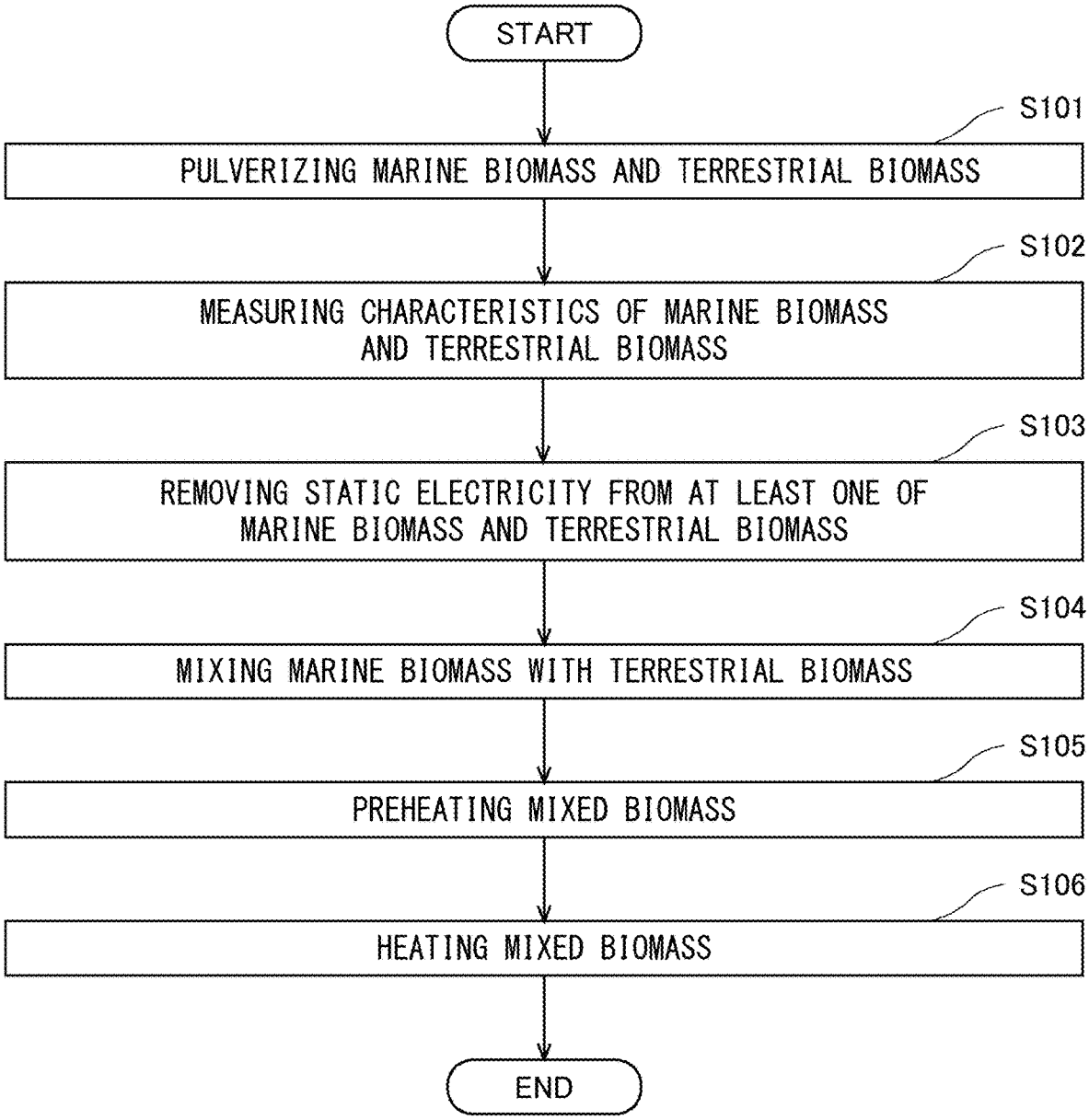
FIG. 2 is a flowchart showing an example of a biochar production method according to an embodiment.

Next, a flow of the biochar production method according to this embodiment will be described with reference to FIG. 2. In the biochar production method according to this embodiment, first, the marine biomass 20 and the terrestrial biomass 30 are pulverized (Step S101). In Step S101, the marine biomass 20 and the terrestrial biomass 30 are pulverized so that they both have predetermined particle sizes, that is, particle sizes different from each other. Specifically, for example, the marine biomass 20 may be pulverized so that the particle size median diameter thereof becomes greater than or equal to 100 μm but smaller than or equal to 300 μm. Further, the terrestrial biomass 30 may be pulverized so that the particle size median diameter thereof becomes greater than or equal to 300 μm.

Next, characteristics of the marine biomass 20 and the terrestrial biomass 30 are measured (Step S102). In Step S102, specifically, a pH of the marine biomass 20 and a pH of the terrestrial biomass 30 are measured. A ratio of the mixture of the marine biomass 20 to that of the terrestrial biomass 30 and the like are determined based on a result of the measurement of the pH in Step S102. In Step S102, an electric charge of each of the marine biomass 20 and the terrestrial biomass 30 is preferably measured. It may be determined whether or not the static electricity needs to be removed from the marine biomass 20 and the terrestrial biomass 30 based on a result of the measurement of the electric charge in Step S102.

Next, the static electricity may be removed from at least one of the marine biomass 20 and the terrestrial biomass 30 (Step S103). Step S103 may be performed when it is determined in Step S102 that the static electricity needs to be removed. Note that, in the example shown in FIG. 1, although Step S103 is performed after Step S102, Step S103 may be performed in parallel with Step S102 or before Step S102. The means for removing the static electricity is not limited to particular means; for example, the static electricity may be removed by electrostatic adsorption using an ionizer.

Figure 3:
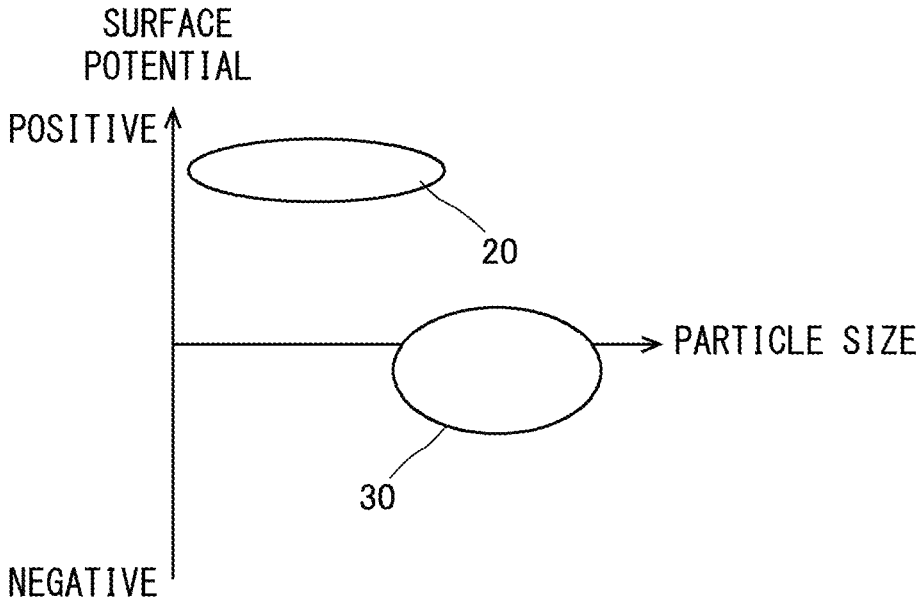
FIG. 3 is a graph showing an example of a surface potential and a particle size of biomass.

FIG. 3 shows a relationship between a surface potential and a particle size of each of the marine biomass 20 and the terrestrial biomass 30 when the static electricity is removed only from the terrestrial biomass 30. In the example shown in FIG. 3, the terrestrial biomass 30 has a particle size larger than that of the marine biomass 20. Therefore, in the example shown in FIG. 3, in order to reduce the amount of energy required to remove the static electricity, the static electricity is removed only from the terrestrial biomass 30. The terrestrial biomass 30 is normally positively charged. Therefore, the terrestrial biomass 30 is electrically brought close to neutral by removing the static electricity therefrom using an ionizer. Further, the marine biomass 20 is normally positively charged. By performing Step S103, the marine biomass 20 and the terrestrial biomass 30 can be more homogeneously mixed and compounded by charging due to a potential difference between the marine biomass 20 and the terrestrial biomass 30.

Note that, in the example shown in FIG. 3, although the static electricity is removed only from the terrestrial biomass 30, the static electricity may be removed only from the marine biomass 20, or the static electricity may be removed from both the marine biomass 20 and the terrestrial biomass 30. Further, the terrestrial biomass 30 may be negatively charged and the marine biomass 20 may be positively and uniformly charged in order to further strengthen the composition of particles. In this case, electrostatic coupling between the terrestrial biomass 30 and the marine biomass 20 becomes stronger.

Referring back to FIG. 2, the description will be continued. Next, the marine biomass 20 and the terrestrial biomass 30 are mixed (Step S104). In Step S104, the marine biomass 20 and the terrestrial biomass 30 are mixed at the ratio of the mixture of the marine biomass 20 to that of the terrestrial biomass 30 determined based on the pHs measured in Step S102, to thereby obtain the mixed biomass. The marine biomass 20 and the terrestrial biomass 30 have particle sizes different from each other. Thus, in the mixed biomass, the marine biomass 20 and the terrestrial biomass 30 are homogeneously mixed and compounded. Therefore, there is no unevenness in the pH inside the mixed biomass.

In general, biomass contains various components, and these components are often localized. Charging characteristics change depending on the content ratio and localization of the components. Therefore, simply mixing different kinds of biomass causes particles to come into contact with each other and have a positive electric effect on each other, with the result that, for example, the particle are often aggregated. Therefore, in order to reliably compound different kinds of biomass, it is preferable to adjust a charged state of each biomass before they are mixed.

Next, the mixed biomass may be preheated (Step S105). Step S105 is preferably performed using waste heat of the heating (Step S106) described later in order to reduce the input of energy. Step S105 may be performed, for example, at about 150 °C. When the marine biomass 20 is derived from seaweed, it contains polysaccharides such as alginic acid. Therefore, when Step S105 is performed, the mixed biomass can be bound by polysaccharides contained in the marine biomass 20 before the main heating. Further, the marine biomass 20 contains volatile odor components. Therefore, when Step S105 is performed, the odor specific to the marine biomass 20 can be removed before the main heating.

Next, the mixed biomass is heated, that is, the main heating is performed (Step S106). Step S106 is performed at a low temperature in a low oxygen atmosphere. Specifically, Step S106 is performed at a temperature higher than or equal to 300 °C but lower than or equal to 350 °C. As described above, there is no unevenness in the pH inside the mixed biomass and the pH has been adjusted to a predetermined range. Therefore, even when the mixed biomass is heated at a low temperature, biochar having a stable alkaline pH is obtained. In other words, it is not necessary to heat the mixed biomass at a high temperature in order to exhibit an alkaline property of ash. Thus, by the biochar production method according to this embodiment, it is possible to produce biochar having a stable pH even at a low heating temperature. Further, since biochar can be produced at a low heating temperature by the biochar production method according to this embodiment, volatile components can be suppressed and the amount of biochar produced can be increased.

Note that the present disclosure is not limited to the above-described embodiments and may be changed as appropriate without departing from the scope and spirit of the present disclosure.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A biochar production method comprising:

measuring a pH of a terrestrial-derived raw material and a pH of a marine-derived raw material;

determining a mixing ratio of the terrestrial-derived raw material and the marine-derived raw material based on the measured pH values;

mixing the terrestrial-derived raw material with the marine-derived raw material at the mixing ratio; and producing biochar by heating the mixed raw material at a temperature higher than or equal to 300 °C but lower than or equal to 350 °C in a low oxygen atmosphere.

2. The biochar production method according to claim 1, further comprising preheating the mixed raw material prior to the heating.

3. The biochar production method according to claim 1, wherein a particle size median diameter of the terrestrial-derived raw material is greater than or equal to 300 μm, and a particle size median diameter of the marine-derived raw material is greater than or equal to 100 μm but smaller than or equal to 300 μm.

4. The biochar production method according to claim 1, further comprising removing a static electricity of at least one of the terrestrial-derived raw material and the marine-derived raw material prior to the mixing.

* * * * *